United States Patent [19]

Buettner

[11] Patent Number: 4,941,180

[45] Date of Patent: Jul. 10, 1990

[54] HEARING AID WITH A CONTACT SPRING CONFIGURATION

[75] Inventor: Gerhard Buettner, Grossenseebach, Fed. Rep. of Germany

[73] Assignee: Siemens Aktiengesellschaft, Berlin and Munich, Fed. Rep. of Germany

[21] Appl. No.: 73,537

[22] Filed: Jul. 15, 1987

[30] Foreign Application Priority Data

Jul. 21, 1986 [DE] Fed. Rep. of Germany ..... 3624568
Jul. 21, 1986 [DE] Fed. Rep. of Germany ..... 3624588
Jul. 21, 1986 [DE] Fed. Rep. of Germany ..... 3624619

[51] Int. Cl.[5] ..... H04R 25/00

[52] U.S. Cl. ..... 381/69.2; 381/68.7; 381/69

[58] Field of Search ..... 381/68, 69, 69.1, 69.2, 381/68.1–68.7, 23.1

[56] References Cited

U.S. PATENT DOCUMENTS 2,975,226 3/1961 Lehr ..... 381/69.2
3,475,566 10/1969 Bauer ..... 381/68.7
3,701,862 10/1972 Vignini ..... 381/69.2

FOREIGN PATENT DOCUMENTS 2503253 7/1976 Fed. Rep. of Germany .
1153195 5/1969 United Kingdom ..... 381/69.2

*Primary Examiner*—Jin F. Ng
*Assistant Examiner*—Danita R. Byrd
*Attorney, Agent, or Firm*—Mark H. Jay

[57] ABSTRACT

A miniature hearing aid has data storage components, amplification components, and a hinged battery compartment in which a battery may be disposed. A latch, in conjunction with a switch, allows for a selection of the operational mode of the hearing aid by positioning the hinged battery compartment at various angles to the hearing aid housing. The battery is held firmly in the battery compartment in the various switching positions by a contact spring, which also serves as the electrical connection between the battery and various electrical component groups housed within the hearing aid. The battery can be disconnected from the amplification components while remaining connected to the data storage components.

20 Claims, 1 Drawing Sheet

86 P 3239 US

HEARING AID WITH A CONTACT SPRING CONFIGURATION

BACKGROUND OF THE INVENTION

1. Field of the Invention

The present invention relates to a miniature hearing aid, and in particular to a hearing aid with a contact spring configuration.

2. Description of the Prior Art

Due to the limited availability of space in hearing aids, common hearing aids (e.g. DE-AS 25 03 253) are frequently designed such that they can be turned on or off by means of a swivelling battery compartment, thereby eliminating the need for a separate on/off switch. The two contact springs are positioned relative to the battery compartment in such a way, that they touch the battery only when the compartment is swung fully into the housing of the hearing aid. In this first position ("On"-position) the hearing aid is activated: all components requiring current (including the amplifier) are connected to the voltage source. The swivelling battery compartment can, however, be placed in two additional positions. In a second position ("Off"-position) the compartment is partially swung into the housing. The battery touches at most one Contact spring. Since the battery compartment is still mostly contained within the housing, the battery cannot be removed from or fall out of the compartment. This position corresponds to the hearing aid being completely turned off, sInce all the components requiring current (including the amplifier) are disconnected from the battery. In the third position, the battery compartment is swung completely out of the hearing aid housing ("Battery-change"-position). The battery can be removed while the compartment is situated in the third position.

U.S. Pat. No. 4,783,816 describes a hearing aid to be worn behind the ear, which comprises at its lower end a hinged battery compartment with a latch-notch mechanism. This latch-notch mechanism serves simply as a lock, however, and not, for example, as an on/off switch. Nor can this construction be easily adapted to function as an on/off switch: simply fashioning additional notches for the latch would not be sufficient, since the battery would sit tightly in the compartment in only the innermost latch position. In the outer latch positions, the battery would rattle in the compartment.

In consideration of recent technological innovations relating to the use of remote control and data storage in hearing aids (as described, for example, in U.S. Pat. No. 4,845,755), it becomes disadvantageous to disconnect all the components housed in the hearing aid from the voltage source in the "off" position. Doing so eliminates the possibility of utilizing remote control. Besides, by shutting off the hearing aid completely, any control data which was stored in the memory is erased. Thus the data must be reprogrammed every time the hearing aid is turned on.

SUMMARY OF THE INVENTION

It is an object of the present invention to provide a miniature hearing aid comprising a technically simple and space-saving latch-notch mechanism for placing the hearing aid in a plurality of switching positions while insuring that the battery is held firmly (i.e. without rattling) in place in all closed switching positions.

In accordance with the principles of the present invention a miniature hearing aid is provided which comprises:

(a) a hearing aid housing;

(b) electrical and/or electromechanical components disposed in said hearing aid housing;

(c) a battery;

(d) a compartment for retaining said battery, said compartment being hinged to said hearing aid housing;

(e) a latching means for said battery compartment, whereby said latching means enables said hearing aid to assume a plurality of switching positions in different latching positions of said latching means; and (f) a contact spring means disposed in said battery compartment, which contact spring means presses agaInst said battery retained in said battery compartment with differing resiliencies dependent on varying switching positions of said battery compartment assumed in different latching positions of said latching means.

By pressing the battery into the battery compartment with a plurality of resiliencies the battery is prevented from rattling in each of the various switching positions. Furthermore, since the invention allows for a plurality of switching positions, one switching position can be established, in which a portion of the components within the hearing aid, such as the amplification means, is disconnected from the power source, while other components, such as those relating to remote control and/or data storage, continue to draw current from the battery. Therefore, in a preferred embodiment of the invention the contact spring means comprises a variable contact for said plurality of switching positions. Nevertheless, also a separate variable contact could be utilized for this purpose. Then making use of a variable contact as part of the contact switch means, the switching position described above doubles as the "Off"-position of the hearing aid. Thus, the remote control and data storage components are disconnected from the battery only when the battery is changed. The above-mentioned switching position can be realized without resorting to a separate switch, since the various switching positions are determined by adjusting the contact spring means within the battery compartment. This is best achieved (in a further preferred embodiment) by fashioning one of the two contacts for the battery as a contact comprising two springs. These two series work in conjunction with a latch-notch mechanism to provide a first switching position, in which all electrical components contained in the hearing aid are connected to the battery, a second switching position, in which only a part of the electrical components are connected to the battery, and a third switching position for removing and exchanging the battery, in which all the electrical components are disconnected from the battery.

The foregoing and other objects, features and advantages of the invention will be apparent from the following more particular description cf a preferred embodiment of the invention, as illustrated in the accompanying drawings.

DETAILED DESCRIPTION OF THE PREFERRED EMBODIMENTS

Figure 1:
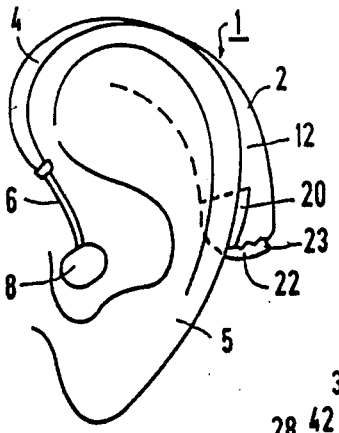
FIG. 1 is a plan view of a hearing aid with a housing to be worn behind the ear comprising a battery compartment and contact spring means with a switching means according to the principles of the present invention.
Figure 2:
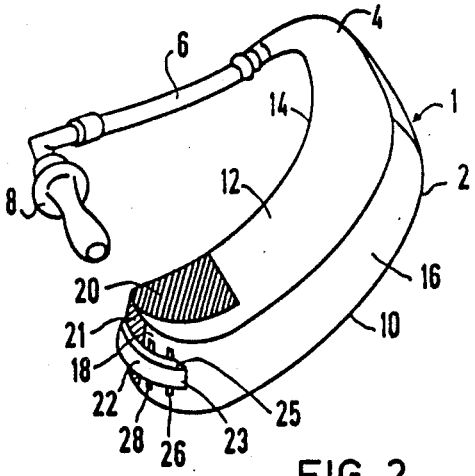
FIG. 2 is an enlarged perspective view of the hearing aid shown in FIG. 1 removed from the ear with its battery compartment swung fully onto the housing.

A behind-the-ear-hearing aid is shown in FIGS. 1 and 2 and is generally referenced at 1. The hearing aid comprises a housing 2, which contains various components, such as a microphone, an amplifier, a receiver, a battery, etc. A hook 4 is used for positioning the hearing aid 1 behind the ear 5. The hook 4 as well as a tube 6 acoustically connect the hearing aid housing 2 with an earpiece 8, located at the end of tube 6 and positioned in the auditory canal of the ear, such that the hearing aid 1 is acoustically connected with the impaired ear. The housing 2 has a first and a second side surface 10, 12, a front surface 14, which faces the ear 5 when positioned on the ear, a rear surface 16 facing away from the ear, and a base 18, which faces downwardly while the hearing aid is being worn.

A hinged battery compartment 20 is located at the distal end of the housing 2, where the base 18 is also located. The battery compartment 20 forms part of the housing 2, since it comprises distal portions of both side surfaces 10, 12, the front surface 14, and the base 18.

There is a clasp 22 attached to the base portion 21 of the battery compartment 20. Approximately half of the clasp 22 juts out beyond the base portion 21 of the compartment 20 and, when the battery compartment 20 is swung fully onto the housing 2, reaches out in the direction of rear surface 16 onto the base surface 18 of housing 2.

The end 23 of the clasp 22 which juts furthest out of base 18 comprises a protrusion (latch 25) running across the inner surface 24 of the clasp 22. The latch 25 can be selectively positioned in one of two notches 26, 28 which run parallel to one another across the base 18 of housing 2. It should be noted that the notches could equally well be disposed on the clasp and, accordingly, the latch on the base of the housing.

Figure 4:
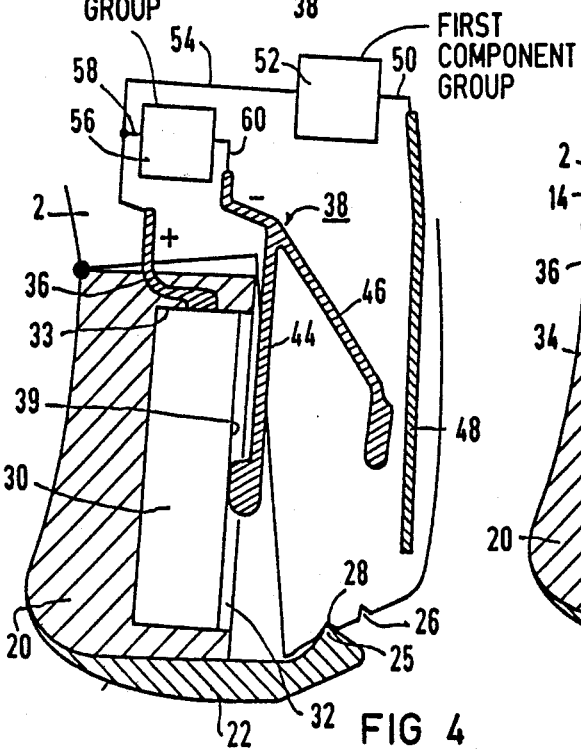
FIG. 4 is an enlarged plan view and partial cross section of the distal end of the housing with the battery compartment swung partially away from the housing.
Figure 3:
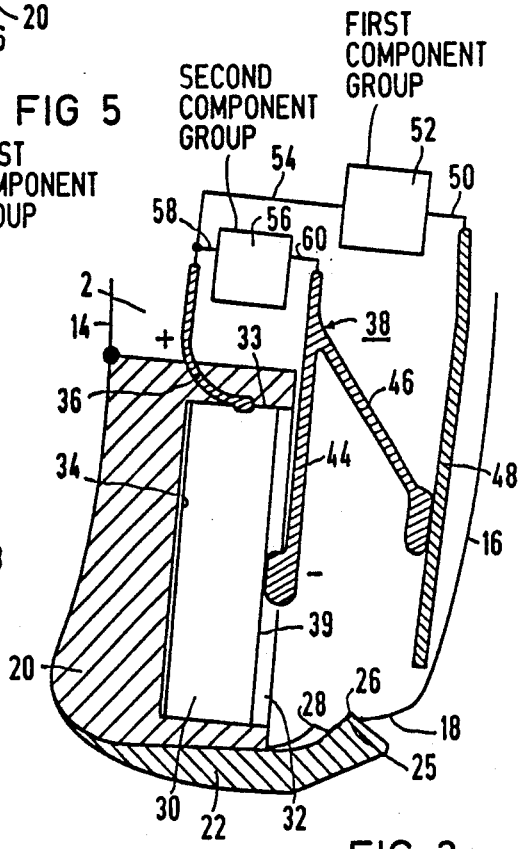
FIG. 3 is an enlarged plan view and partial cross section of the distal end of the housing with the battery compartment swung fully onto the housing.

FIGS. 3 and 4 show an enlarged view of the distaI end of the housing 2, comprising the battery compartment 20, the latch-notch mechanism 22 to 28, which enables the hearing aid 1 to be turned on and off without utilizing additional switches, and the contact spring means 36, 38, 44 to 48.

In FIG. 3 the latch 25 of the clasp 22 is latched in the first notch 26. The compartment 20 is fully swung onto the hearing aid housing. In this position, the battery 30 sits firmly in a recess 32 for the battery in the compartment 20. The cylindrical wall 33 of the battery 30, which is the positive pole, lies against a first contact 36. The flat battery surface 39, which forms the negative pole, touches a first spring 44 of a second contact 38 comprising two springs. This first spring 44 is resilient and pushes the battery 30 into the recess 32 of the battery compartment 20, thereby bringing the battery 30 into contact with the first contact 36. Additionally, in the position depiCted in FIG. 3, the battery 30 pushes back the second contact 38 in the direction of rear surface 16. This causes the second spring 46 of the second contact 38 comprising two springs to be pushed back against a contact plate 48. The contact plate 48 is connected electrically with a first component group 52, which includes the amplifier of the hearing aid, by an electrical line 50. A further electrical line 54 connects the first component group 52 with the first contact 36. Thus, a closed circuit supplying current to the amplifier section is formed if the second spring 46 contacts the contact plate 48.

An additional closed circuit simultaneously supplies current to a second component group 56, that includes a remote control receiver as well as a memory for data storage. This second circuit is formed by the first contact 36, an electrical line 58, the component group 56, an additional electrical line 60, the second contact 38, and the battery 30. Thus, in this first switching position ("on"-position) all components requiring an electric current (i.e. component groups 52 and 56) are contacted to the battery.

In FIG. 4 the latch 25 of the clasp 22 is latched in the second notch 28. In this second Switching position, the first spring 44 of the second contact 38 comprising two springs remains in contact with the flat battery surface 39 of battery 30 and continues to push the battery into the recess 32 of the battery compartment 20. The battery thus still lies firmly against the first contact 36. No current flows however, through the first component group 52, since the second spring 46 of the second contact 38 comprising two springs no longer touches the contact plate 48. In this second switching position, defined as the "off"-position, the component group 52 comprising the amplifier is disconnected from the battery. The component group 56 comprising the remote control receiver and/or the memory for data storage remains on, since the circuit comprising the first contact 36, the electrical line 56, the first spring 44 Of the second contact 38, and the electrical line 60 is still closed.

Figure 5:
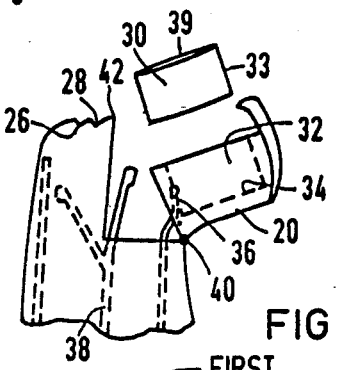
FIG. 5 is an enlarged plan view of the distaI end of the housing with the battery compartment swung completely away from the housing.

FIG. 5 shows the battery compartment 20 completely opened. The battery 30 can now be removed from or placed in the recess 32 in compartment 20. Although the battery wall 33 continues to contact the first contact 36, no current can flow, sInce the second contact 38 is disconnected from the flat battery surface 39. The hearing aid is thus switched off entirely in this third position.

To close the battery compartment 20, il must be swung towards the housing 2 around an axis 40, which lies perpendicularly to the side surfaces 10, 12. A greater force must be exerted in order to push the latch 25 of clasp 22 onto the base surface 18 of the housing 2, due to a protrusion 42 disposed at the tip of base 18. The protrusion 42 insures that the battery compartment 20 does not inadvertently spring open once it has been shut.

The battery compartment 20 can be repositioned by using, for example, the thumb to push the rear portion of the clasp 22 back into the desired position.

The battery 30 lies perpendicularly to the side surfaces 10, 12 of housing 2 in the battery compartment 20. The compartment snaps onto housing 2 instead of being swung into the housing, as is often the case with hearing aids commonly found on the market. The advantage in this becomes apparent when changing the battery, since the battery is less likely to fall out of the compartment when it is in an open upright position. Additionally the battery contacts are less likely to be damaged in the proposed embodiment. Contact spring 44 is, for example, far removed from the vicinity of the battery recess 32 in the third position. Furthermore, when closing compartment 20, the battery approaches the contact spring 44 perpendicularly, rather than sliding over the contact spring from the side, as is common by other hearing aids. Thus, the present embodiment eliminates the common former danger that the battery could catch the edge of the contact and bend it out of shape, thereby irreparably damaging it. Although modifications and changes may be suggested by those skilled in the art, it is the intention of the inventor to embody within the scope of the patent warranted hereon all changes and modifications as reasonably and properly come within the scope of his contribution to the art.

I claim as my invention:

1. A miniature hearing aid comprising:

(a) a hearing aid housing;

(b) electrical components disposed in said hearing aid housing;

(c) a compartment for retaining a battery, said compartment being hinged to said hearing aid housing;

(d) a latching means for said battery compartment, said latching means comprising (d1) a latch-notch mechanism disposed on said hearing aid housing and (d2) a clasp which is disposed on said battery compartment and which juts over a base of said hearing aid housing whereby said latching means enables said hearing aid to assume a plurality of switching positions in different latching positions of said latching means; and (e) a contact spring means disposed in said battery compartment, which contact spring means presses against said battery retained in said battery compartment with differing resiliencies dependent on varying switching positions of said battery compartment assumed in different latching positions of said latching means, wherein a single variable contact within said contact spring means can be selectively disposed in one of three switching positions, whereby all of said electrical components are electrically connected to said battery in the first switching position, only a part of said electrical components are electrically connected to said battery in the second switching position, and all of said electrical components are electrically disconnected from said battery in the third switching position.

2. A miniature hearing aid according to claim 1, wherein said battery comprises a first battery pole and a second battery pole, said first battery pole lying firmly against a first contact of said contact spring means, and wherein a second contact of said contact spring means comprises first and second springs, whereby the first spring presses against said second battery pole of said battery with differing resiliencies in said first and in said second switching positions, and whereby the second spring provides for a first electrical connection, which connects all of said electrical components in said first switching position and whereby the second spring provides for a second electrical connection which connects only part of said electrical components in said second switching position.

3. A miniature hearing aid according to claim 2, wherein said first electrical connection is determined by a first electrical connection line leading to a first component group of said electrical components in conjunction with a second electrical connection line leading to a second component group of said electrical components, and wherein said second spring of said contact comprising two springs, in conjunction with said first spring of said contact comprising two springs, is connected to said second electrical connection line in said first as well as in said second switching positions, while only the second spring of said contact comprising two springs is connected to said first electrical connection line in said first switching position.

4. A miniature hearing aid according to claim 2, wherein said first spring of said contact comprising two springs, which normally presses against said second battery pole, is removed from the vicinity of said battery in said third switching position, in order that the battery can be disconnected from said first contact and can be replaced.

5. A miniature hearing aid according to claim 2, wherein the position of said battery compartment including said battery can be varied relative to said hearing aid housing, thereby causing said contact comprising two springs to be disposed selectively in one of said switching positions.

6. A miniature hearing aid according to claim 5, wherein said battery is retained in a battery compartment hinged to said hearing aid housing, in which said battery is pressed resiliently against said first contact if said first spring of said contact comprising two springs is in contact with said battery, which occurs when said battery compartment including said battery is disposed in a first hinge position, which corresponds to said first switching position or, if said battery compartment including said battery is disposed in a second hinge position, which corresponds to said second switching position.

7. A hearing aid according to claim 6, wherein said first spring of said contact comprising two springs is removed from the vicinity of said battery in a third hinge position of said battery compartment, which corresponds to said third switching position.

8. A miniature hearing aid according to claim 7, wherein said first spring is removed sufficiently from the vicinity of he location of the battery when the battery compartment is in said third hinge position, so that the battery can be removed from said battery compartment without difficulty and so that a new battery can be placed into the battery compartment when empty.

9. A miniature hearing aid according to claim 1, which further comprises both means for amplifying signals in said hearing aid and with electrical components for remote control, which can both be electrically connected to the battery, wherein both the means for amplifying signals and the electrical components for remote control are connected electrically with said battery in said first switching position.

10. A miniature hearing aid according to claim 9, wherein said means for amplifying signals in said hearing aid are note connected to said battery, while said electrical components for remote control are connected electrically with said battery in said second switching position.

11. A miniature hearing aid according to claim 9, wherein neither said means for amplifying signals in said hearing aid nor said electrical components for remote control are connected to said battery in said third switching position.

12. A miniature hearing aid according to claim 1, wherein an inner surface of said clasp facing said hearing aid housing in conjunction with a base of said hearing aid housing facing said inner surface of said clasp comprise said latch-notch mechanism.

13. A miniature hearing aid according to claim 12, wherein a latch is disposed on said clasp of said battery compartment and two corresponding notches are formed by recesses in said hearing aid housing.

14. A miniature hearing aid according to claim 12, wherein said hearing aid housing comprises a first and a second side surface, a front surface, a rear surface, and a distal base, whereby distal portions of both side surfaces, of either said front or said rear surface, and of said base form the compartment for retaining the battery, which compartment is hinged to said hearing aid housing and swivels on an axis, which runs perpendicularly to said side surfaces, such that, when said compartment is tipped open, a recess for said battery disposed in said compartment becomes accessible from outside the battery compartment, and wherein said clasp is disposed on the outer surface of said compartment.

15. A miniature hearing aid according to claim 14, wherein said recess for said battery comprises a compartment bottom, which lies substantially parallel to said front and said rear surface of said hearing aid housing when said compartment is latched to said hearing aid housing, such that the flat surfaces of a battery which is disposed in said compartment also lie substantially parallel to said front and said rear surface in said latched position.

16. A miniature hearing aid according to claim 14, wherein said clasp is disposed on said base portion of said compartment.

17. A miniature hearing aid according to claim 16, wherein said clasp juts with one end over an edge of said base portion of said compartment, said edge being located opposite said compartment bottom, and wherein said jutting end of said clasp can be latched to that portion of the housing base which is not part of said compartment when said compartment is in a latched position.

18. A miniature hearing aid comprising:

(a) a hearing aid housing;

(b) components which require an electrical current to be activated;

(c) a compartment for retaining a battery;

(d) a latching means for said battery compartment;

(e) a contact spring means for electrically connecting said battery and said components;

whereby said latching means and said spring means function as a switching means enabling said battery to be disconnected from amplification components while being connected to data storage components.

19. A miniature hearing aid according to claim 18, wherein said switching means enables said battery to be disconnected from amplification components while being connected to data storage and remote control components.

20. A miniature hearing aid according to claim 18, wherein said switching means comprises a variable contact.

* * * * *